US012030692B1

(12) United States Patent
Carmona

(10) Patent No.: US 12,030,692 B1
(45) Date of Patent: Jul. 9, 2024

(54) TRANSFORMABLE STORAGE CONTAINER

(71) Applicant: Michael B. Carmona, Agoura Hills, CA (US)

(72) Inventor: Michael B. Carmona, Agoura Hills, CA (US)

( * ) Notice: Subject to any disclaimer, the term of this patent is extended or adjusted under 35 U.S.C. 154(b) by 0 days.

(21) Appl. No.: 18/526,438

(22) Filed: Dec. 1, 2023

Related U.S. Application Data

(60) Provisional application No. 63/522,082, filed on Jun. 20, 2023.

(51) Int. Cl.
*B65D 21/08* (2006.01)

(52) U.S. Cl.
CPC ..... *B65D 21/086* (2013.01)

(58) Field of Classification Search
CPC .... B65D 21/086; B65D 21/08; A45C 7/0037; A45C 7/0036; A45C 7/0072; A45C 7/0077
See application file for complete search history.

(56) References Cited

U.S. PATENT DOCUMENTS 6,065,873 A * 5/2000 Fowler ..... A45C 3/04 383/33
6,206,224 B1 * 3/2001 Potts ..... B62B 3/1464 229/117.07
9,016,494 B1 * 4/2015 Hernandez ..... A45C 3/04 220/592.2
2007/0205243 A1 * 9/2007 Potts ..... A45C 7/0063 224/539
2012/0000912 A1 * 1/2012 Potts ..... A45C 7/0022 220/666
2015/0353232 A1 * 12/2015 Kandel ..... A47G 23/06 47/65.5
2016/0039595 A1 * 2/2016 Bright ..... B65D 47/265 220/592.2
2016/0068306 A1 * 3/2016 Heinz ..... B65D 85/70 220/6
2016/0347502 A1 * 12/2016 Quinn ..... B65D 25/2852
2019/0061991 A1 * 2/2019 Woodruff ..... B65D 25/06
2020/0407114 A1 * 12/2020 Knob ..... B65D 21/086
2021/0112937 A1 * 4/2021 Gaye ..... A45C 3/001
2022/0323300 A1 * 10/2022 Cleveland ..... G01M 3/3218
2023/0363503 A1 * 11/2023 Chen ..... A45C 7/0077

* cited by examiner

*Primary Examiner* — Don M Anderson
(74) *Attorney, Agent, or Firm* — QuickPatents; Kevin Prince

(57) ABSTRACT

The disclosure pertains to a storage container system and a method of transforming the same. The system includes a container of a geometric shape, which is transformable and has a frame with two ends. The container houses sections in portions of the space divided at approximately equal distances from the two ends. Clasp catchers are located below the border of the upper surface, approximately at the midpoint of the borders, and on the bottom side of some of the sections including the sections closest to either of the two ends. The system can be laterally condensed or laterally enlarged where the frame transforms to house varied spaces of sections.

13 Claims, 8 Drawing Sheets

TRANSFORMABLE STORAGE CONTAINER

CROSS REFERENCE TO RELATED APPLICATIONS

This application claims the benefit of U.S. Provisional Patent Application 63/522,082, filed on Jun. 20, 2023, and incorporated herein by reference.

STATEMENT REGARDING FEDERALLY SPONSORED RESEARCH AND DEVELOPMENT

Not Applicable.

FIELD OF THE INVENTION

The present disclosure relates to the field of container systems. Specifically, the disclosure pertains to systems designed for the containment, storage, and organization of items.

BACKGROUND

Storage containers are important in various settings, from domestic households to commercial spaces. Traditional storage containers typically come in predetermined, fixed sizes and shapes. While these containers are often robust and durable, their rigid dimensions can lead to inefficient use of space, particularly when the contents do not fully utilize the container capacity. This inefficiency is notably problematic in environments where space conservation is important such as dwellings, vehicles, and office spaces.

The limitations of these conventional containers extend beyond space utilization. Their fixed sizes may cause users to acquire multiple containers of different dimensions to suit varying storage purposes, leading to additional expenses and clutter. Furthermore, these static containers, being unmodifiable in size, lack the adaptability to accommodate fluctuating storage purposes. This rigidity can be a significant drawback in dynamic environments where storage demands often change.

There exists a need for a storage solution that addresses the limitations of fixed-size containers, providing users with more versatile options to meet their varying storage demands. The present disclosure accomplishes these objectives.

SUMMARY OF THE INVENTION

In various aspects, the present disclosure may provide a storage container system, which may be designed to offer flexibility and adaptability and may be designed to accommodate various storage or containing purposes. This system may feature a storage container configured as a first quadrilateral prism which may be capable of transformation. In various aspects, the storage container system may include a top face and a bottom face, wherein the top face may be positioned opposite from the bottom face. In other aspects, the storage container system may include a left face and a right face which may extend between the top face and the bottom face, wherein the left face may be positioned opposite from the right face. In various aspects, the storage container system may include two lateral side walls which may extend between the left face and the right face and may be oriented perpendicular thereto. In various aspects, the storage container system may include a top face, a bottom face, a left face, a right face, and lateral side walls which may be configured as quadrilateral polygons. In various aspects, the storage container system may include a rigid frame which may extend to two distal ends, where one distal end may be located at the left face and another distal end may be located at the right face when the storage container is in a fully expanded state. In various aspects, the storage container system may include at least three foldable sections each of which may occupy one-third of a storage container volume positioned at approximately equal distances from the two distal ends.

Various aspects of the container may include three foldable sections which may be strategically integrated within the container volume and may provide versatility. The foldable sections, when expanded and unfolded, may contain a volume approximately the shape of a second quadrilateral prism. The second quadrilateral prism may have an approximately square shape when viewed from above the top face and may have an approximately rectangular shape when viewed from the lateral side wall perspective, further having a top face approximately flush and collocated with one of the three approximately square sections of the rigid frame. In other aspects the second quadrilateral prism may have an approximately square shape when viewed from above the top face and may have an approximately square shape when viewed from the lateral side wall perspective. The foldable section may have two ends parallel to the two distal ends of the storage container system and two lateral side walls perpendicular to the two distal ends of the storage container system. In various aspects, these foldable sections may be divided at approximately one-third distances from the two distal ends of the container, which may enable the system to transition from a laterally condensed state to a laterally expanded state. In certain aspects, this transformation may aide in optimizing the use of space, whether in compact or expansive settings.

In various aspects, the storage container system may be enhanced with one or more clasp catchers for added security and stability. In various aspects, the storage container system may be enhanced with six clasp catchers for added security and stability. These catchers may be strategically positioned with one located below the four edges of the top face opening of the storage container system, approximately at the midpoint of these edges, and one may be located on the underside of two of the three foldable sections. These foldable sections may be positioned closest to the two distal ends of the container. In various aspects, this arrangement may ensure the container remains securely closed and its contents may be protected, regardless of its configuration.

Other features and advantages of the present invention will become apparent from the following more detailed description, taken in conjunction with the accompanying drawings, which illustrate, by way of example, the principles of the invention.

DESCRIPTION OF THE DRAWINGS

The drawings illustrate generally, by way of example, but not by way of limitation, various aspects discussed in the present document.

DETAILED DESCRIPTION

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Reference will now be made in detail to some aspects of the disclosed subject matter, examples of which are illustrated in the accompanying descriptions and figures. While the disclosed subject matter will be described in conjunction with the enumerated claims, it will be understood that they are not intended to limit the disclosed subject matter to those claims. On the contrary, the disclosed subject matter is intended to cover all alternatives, modifications and equivalents, which may be included within the scope of the presently disclosed subject matter as defined by the claims.

Figure 1:
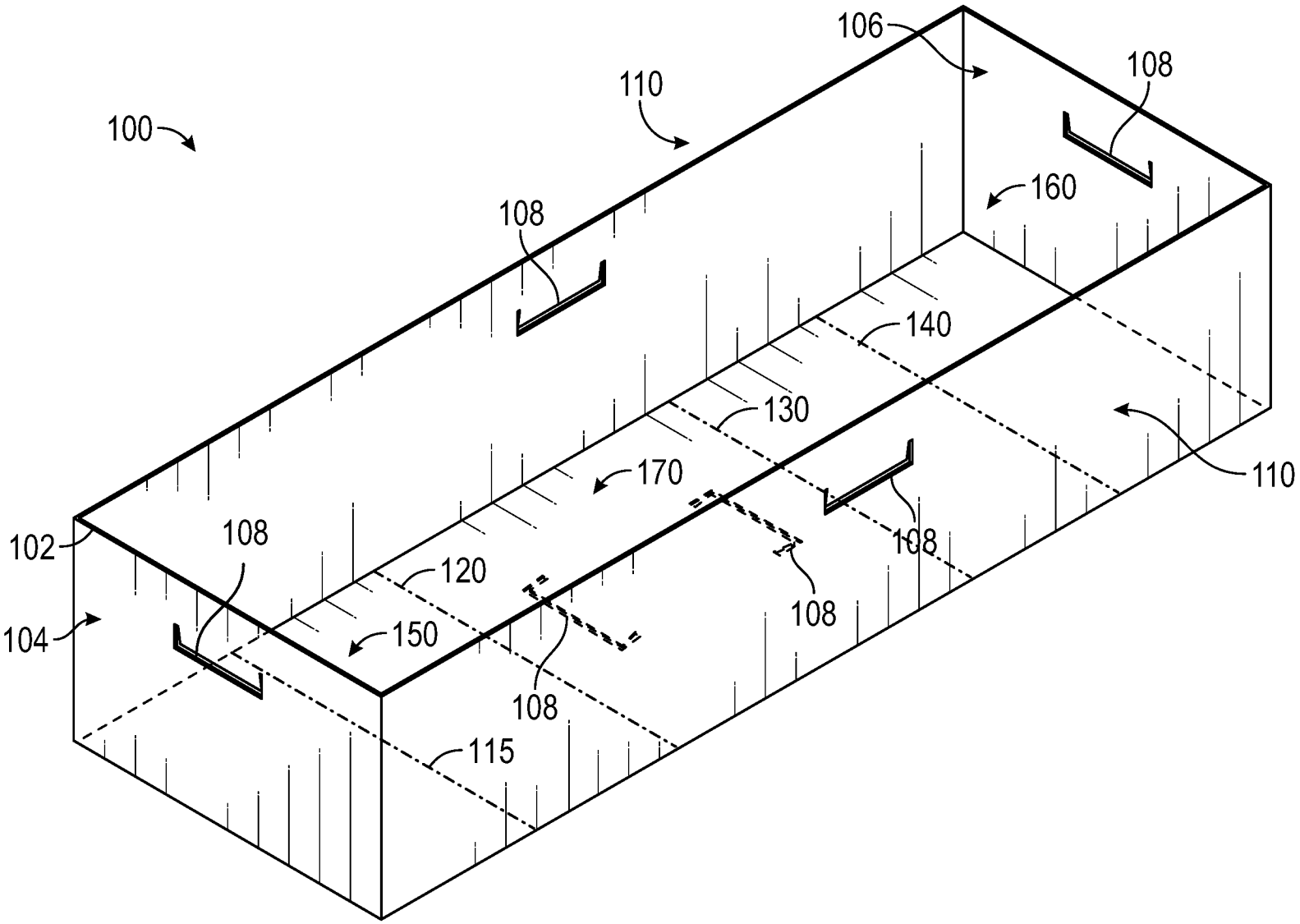
FIG. 1 shows an isometric view of the present container system when in a fully laterally expanded state.

Referring now to the drawings, wherein the drawings are for purposes of illustrating some aspects of the present disclosure only, and not for purposes of limiting the same and wherein like reference numerals designate identical or corresponding parts throughout the several views, and referring particularly to FIG. 1, a transformable storage container system is depicted.

FIG. 1 illustrates an isometric view of a storage container system (100) when fully expanded. In some aspects, the storage container system (100) may be characterized by its ability to transform in size, which may be facilitated by the structural design. In various aspects, the storage container system (100) may include a rigid frame (102) that defines the perimeter of the open top face of the storage container system (100). The rigid frame (102) may be constructed from materials such as plastic and/or silicone and may provide flexibility and durability. In various aspects, this rigid frame (102) may extend around the top face opening of the storage container system (100), which may further provide structural integrity and a point of attachment for additional components.

In FIG. 1, the left face (104) is depicted as one of the two distal ends of the storage container system (100). One or more clasp catchers (108) may be strategically positioned at the midpoint of the left face (104), below the edge of the top face opening, aligning with the rigid frame (102). These one or more clasp catchers (108) may serve as a securing point for a corresponding clasp mechanism (not shown in this figure) that may be part of a lid or cover (not shown) designed to close the storage container system (100). In other aspects, the right face (106) of the storage container system located at the other distal end, may mirror the left face (104) configuration, wherein the right face may include one or more clasp catchers (108) positioned at the midpoint of the right face (106), below the edge of the top face opening of the storage container system (100). In various aspects, the left face (104) and the right face (106) may not be differentiated. In various aspects the left face (104) and the right face (106) may be defined separately for clarity when observing and describing figures herein.

In various aspects, the storage container system (100) may further include lateral side walls (110), which are not differentiated in this figure. In some aspects, these lateral side walls (110) may also include one or more clasp catchers (108) located centrally and below the top face opening of the storage container system (100), similarly to the one or more clasp catchers (108) located on the distal ends, as seen on the left face (104) and the right face (106). In some aspects, these one or more clasp catchers (108) on the lateral side walls (110) may be involved in the secure closure of the storage container system (100) when the lid is applied.

In various aspects, the bottom face of the storage container system (100) may include a first foldable location (115), a second foldable location (120), a third foldable location (130) and a fourth foldable location (140) which may facilitate the transformation of the storage container system (100). In certain aspects, the bottom face of the storage container system (100) may include one or more clasp catchers (108) located between the second foldable location (120) and the third foldable location (130). In some aspects, the storage container system (100) may include two or more foldable sections located at the distal ends of the storage container system (100), where the first foldable section may be bounded by the left face (104) and the second foldable location (120) and where the second foldable section may be bounded by the right face (106) and the third foldable location (130). The third foldable section may be positioned between the first and second foldable section. The first foldable section, the second foldable section and the third foldable section may form part of the storage container system (100) volume and may independently be shaped as quadrilateral polygons. These foldable sections may allow the storage container system to transform in size, adapting to varying storage purposes. The first foldable location (115) and the second foldable location (120) may allow the first foldable section to laterally condense, wherein the first foldable section may include the left face (104). The third foldable location (130) and the fourth foldable location (140) may allow the second foldable section to laterally condense, wherein the second foldable section may include the right face (106). In various aspects, the third foldable section may be laterally condensed using one or more optional additional foldable locations (not shown) located in the third foldable section, causing the storage container system to be transformed to a maximally laterally condensed state. In various aspects, this maximally laterally condensed state may allow the user to stow or store the storage container system (100) itself, where the storage container system (100) is not used for storage.

In some aspects, the first, second and/or third foldable sections, when expanded and unfolded, may each independently contain a volume approximately the shape of a second, third and fourth quadrilateral prism. In some aspects, each of the second, third and fourth quadrilateral prisms may independently have an approximately square shape when viewed from above the top face and may have an approximately rectangular shape when viewed from the lateral side wall perspective. In various aspects, each of the second, third and fourth quadrilateral prisms may independently have an approximately rectangular shape when viewed from above the top face and may have an approximately rectangular shape when viewed from the lateral side wall perspective. In some aspects, each of the second, third and fourth quadrilateral prisms may independently have an approximately square shape when viewed from above the top face and may have an approximately square shape when viewed from the lateral side wall perspective.

In various aspects, the second quadrilateral prism may further include a top face approximately flush and collocated with one of the three approximately square sections of the rigid frame. In some aspects, the foldable section may have two ends parallel to the two distal ends of the storage container system and two lateral side walls perpendicular to the two distal ends of the storage container system.

In some aspects, the bottom face of the storage container system (100) may be divided at approximately one-third distances from the two distal ends. In various aspects, the first foldable location (115) may be located approximately about one-sixth of the width of the storage container system (100) from the left face (104). In various aspects, the second foldable location (120) may be located approximately about one-third of the width of the storage container system (100) from the left face (104). In certain aspects, the third foldable location (130) may be located approximately about one-third of the width of the storage container system (100) from the right face (106). In certain aspects, the fourth foldable location (140) may be located approximately about one-sixth of the width of the storage container system (100) from the right face (106). In certain aspects, the bottom face of the storage container system (100) may include one or more clasp catchers (108) located between the second foldable location (120) and the third foldable location (130).

In various aspects, the storage container system may include m foldable sections made up of n foldable locations. In various aspects, each of the m foldable sections may occupy 1/m of a storage container volume positioned at approximately equal distances from the two distal ends. In certain aspects, each of the n foldable locations may be positioned at approximately equal distances from the two distal ends. In some aspects, the foldable sections may enable the storage container system to transition between a laterally condensed state and a laterally expanded state, thereby altering its volume and shape.

In various aspects, in addition to the one or more clasp catchers (108) located near the top opening, the storage container system (100) may also include one or more clasp catchers (108) (not shown) positioned on the underside of the third foldable section of the storage container system (100), wherein at least one or more clasp catchers (108) faces the left face (104) and at least one or more of the clasp catchers (108) faces the right face (106). In some aspects, these one or more clasp catchers (108) located on the bottom face of the third foldable section of the storage container system (100) may be used to secure clasps located on a lid (not shown) when folded. In some aspects, these one or more clasp catchers (108) may be located on the bottom face of the third foldable section of the storage container system (100) and may improve adaptability and secure closure in various configurations of the storage container system (100).

Figure 2:
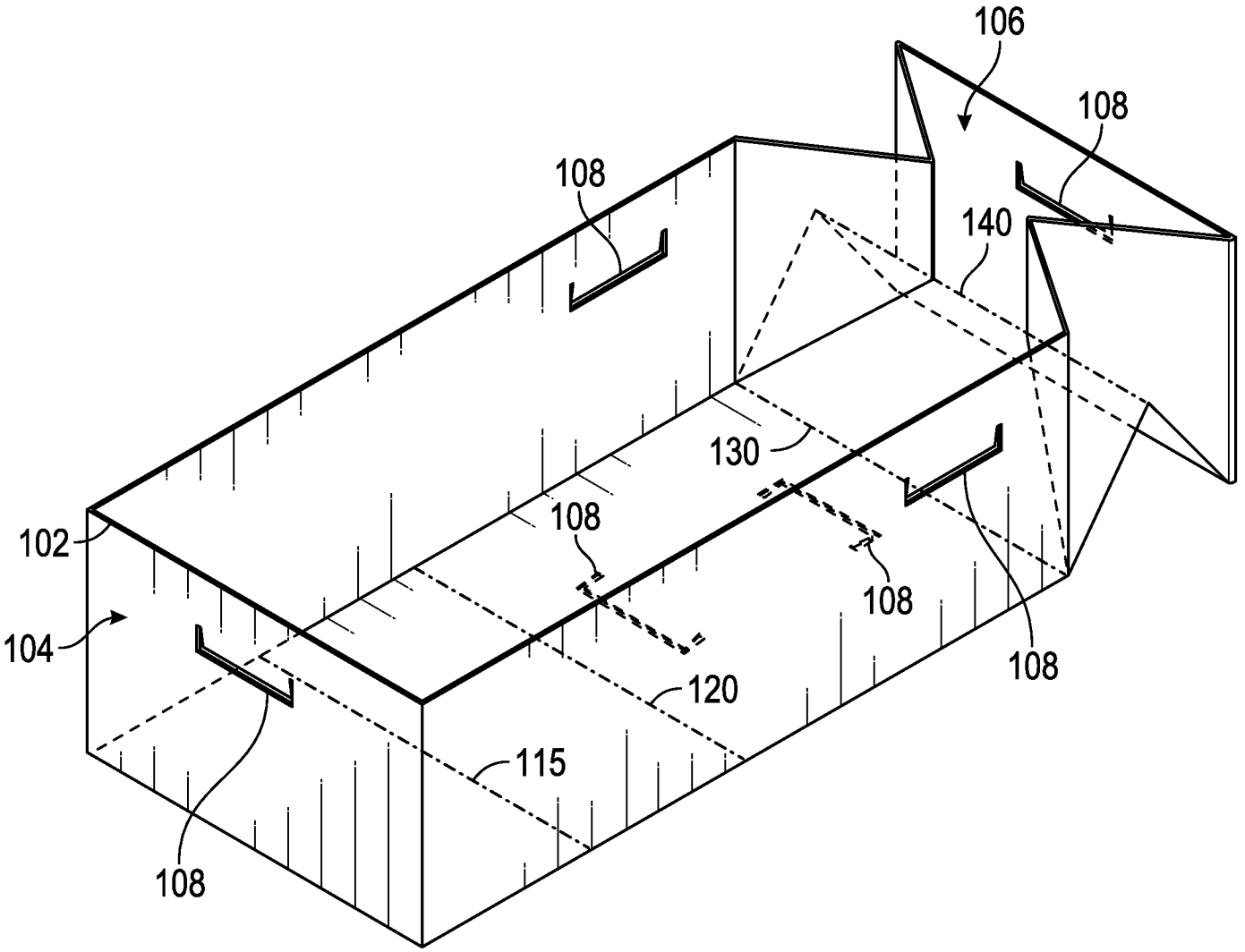
FIG. 2 shows an isometric view of the present disclosure as one end is transitioning from a laterally expanded state to a laterally condensed state and one foldable section is folding.

In FIG. 2, the storage container system (100) is depicted undergoing a transformation in its structure. In some aspects, this transformation is particularly focused on the manipulation of the fourth foldable location (140) to laterally condense the second foldable section. In various aspects, the fourth foldable location (140) may be raised relative to the plane created by the third foldable section and the first foldable section. In other aspects, the fourth foldable location (140) may be lowered relative to the plane created by the third foldable section and the first foldable section. In other aspects, the fourth foldable location (140) may be pinched inward relative to the plane created by the third foldable section and the first foldable section.

In various aspects, the fourth foldable location (140) may be manipulated causing the right face (106) of the storage container system (100) to move in a central direction. In some aspects, this movement may result in the condensation of the width of the storage container system (100), effectively reducing the size of the second foldable section. In various aspects, this condensation may be so extensive that the second foldable section is effectively eliminated, contributing to a more compact and space-efficient configuration of the storage container system (100).

In various aspects, the lateral side walls (110) of the storage container system (100) in the second foldable section may also participate in this condensation process. The lateral side walls (110) may fold inward toward the inside of the storage container system (100) to laterally condense the second foldable section. In various aspects the lateral side walls (110) may fold outward away from the inside of the storage container system (100). In certain aspects, the bottom face of the storage container system (100) may include one or more clasp catchers (108) located between the second foldable location (120) and the third foldable location (130).

Figure 3:
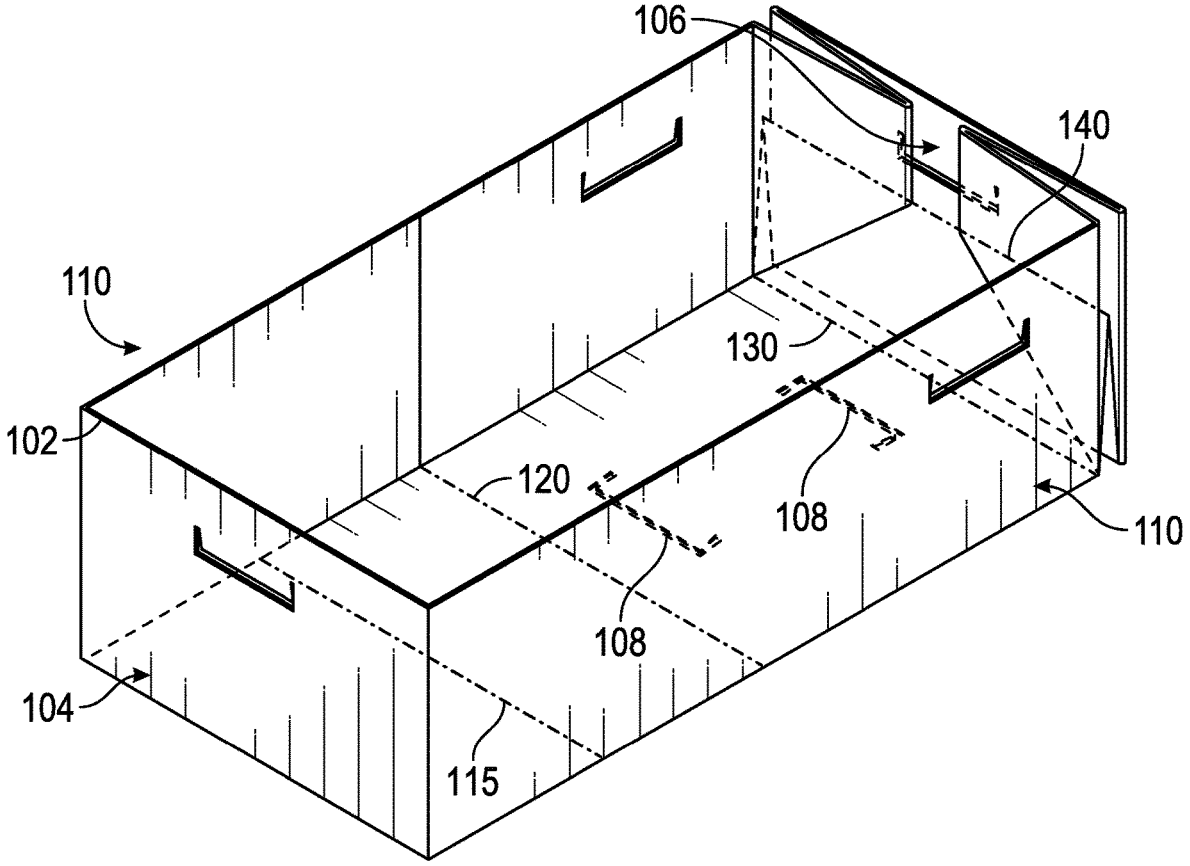
FIG. 3 shows an isometric view of the present disclosure with one end positioned in a laterally condensed state.

In FIG. 3, the storage container system (100) is depicted having undergone a transformation in its structure. In FIG. 3, the storage container system (100) is illustrated with the second foldable section in a laterally condensed state, resulting in the effective elimination of this section. FIG. 3 also depicts the altered position of the fourth foldable location (140). In some aspects, the fourth foldable location (140), after being manipulated, may be raised relative to the plane of the bottom face of the storage container system (100). In some aspects, the fourth foldable location (140), after being manipulated, may rest against or in close proximity to the right face (106) of the storage container system (100). In some aspects, this positioning may signify condensation of the second foldable section, where the fourth foldable location (140) may have been folded up and aligned with the right face (106). In various aspects, the third foldable section may be laterally condensed using one or more optional additional foldable locations (not shown) located in the third foldable section, causing the storage container system to be transformed to a maximally laterally condensed state. In various aspects, this maximally laterally condensed state may allow the user to stow or store the storage container system (100) itself, where the storage container system (100) is not used for storage.

In various aspects, the folding of the fourth foldable location (140) against the right face (106) may significantly reduce the overall width of the storage container system (100), transitioning it into a more compact form. In various aspects, the lateral side walls (110) of the storage container system (100) in the area of the second foldable section may also undergo a folding process, aligning with the newly positioned fourth foldable location (140) and the right face (106). In some aspects, these transformations may allow the storage container system (100) to be adaptable to various storage purposes and spatial constraints. In some aspects, the materials comprising the rigid frame (102) of the storage container system (100) may include plastic and/or silicone and may contribute to the durability and flexibility used for these transformations. In certain aspects, the bottom face of the storage container system (100) may include one or more clasp catchers (108) located between the second foldable location (120) and the third foldable location (130).

Figure 4:
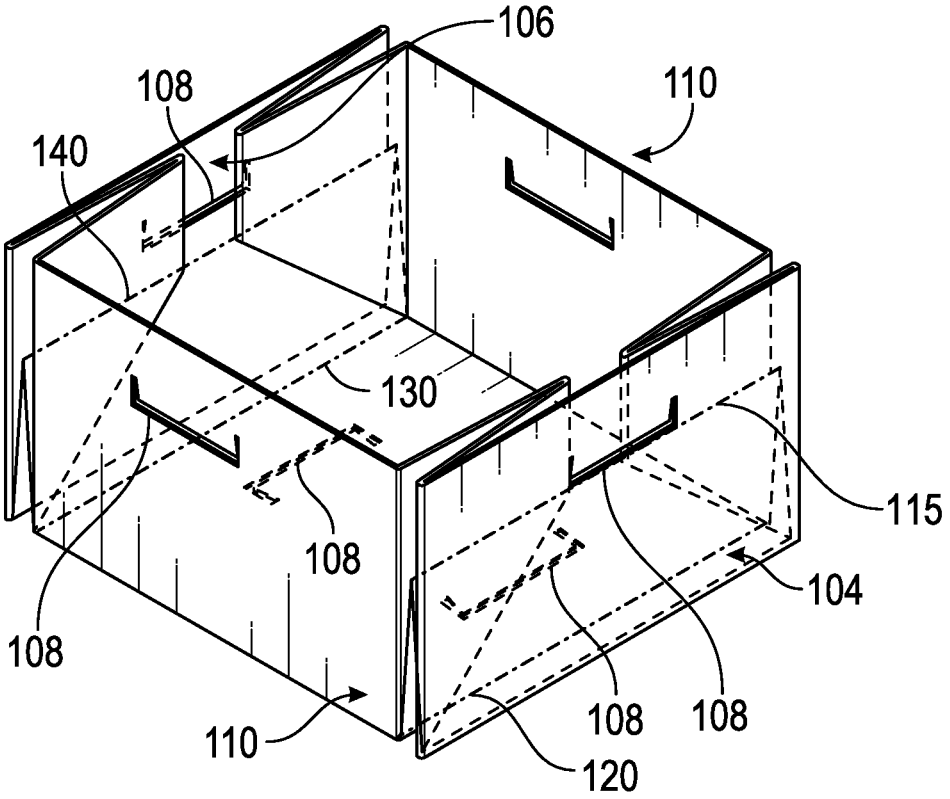
FIG. 4 shows an isometric view of the present disclosure with two ends positioned in a laterally condensed state.

In FIG. 4, the storage container system (100) is depicted with the first and second foldable sections collapsed. In FIG. 4, the second foldable location (120) and fourth foldable location (140) may have previously been manipulated to laterally condense the first foldable section and the second foldable section of the storage container system (100). In various aspects, manipulation of the second foldable location (120) and/or the fourth foldable location (140) may alter the overall shape and size of the storage container system. In various aspects, manipulation may include folding the second foldable location (120) and/or the fourth foldable location (140) upward. In other aspects, manipulation may include folding the second foldable location (120) and/or the fourth foldable location (140) downward. In certain aspects, the bottom face of the storage container system (100) may include one or more clasp catchers (108) located between the second foldable location (120) and the third foldable location (130).

In various aspects, the lateral side walls (110) of the storage container system (100) in the areas of the first foldable section and second foldable section may undergo a similar folding process. In some aspects, this folding process may involve the lateral side walls (110) aligning with the newly positioned second foldable location (120) and fourth foldable location (140), contributing to the overall cubic configuration of the storage container system. In various aspects the lateral side walls (110) may fold inward toward the center of the storage container system (100). In other aspects, the lateral side walls (110) may fold outward away from the center of the storage container system (100). In various aspects, laterally condensing the first foldable section and second foldable section including the lateral side walls (110) located in the first foldable section and second foldable section may result in a transformation of the storage container system (100) from an elongated quadrilateral prism shape, or a laterally expanded state, to a condensed cube-like quadrilateral prism shape or a laterally condensed state.

Figure 5:
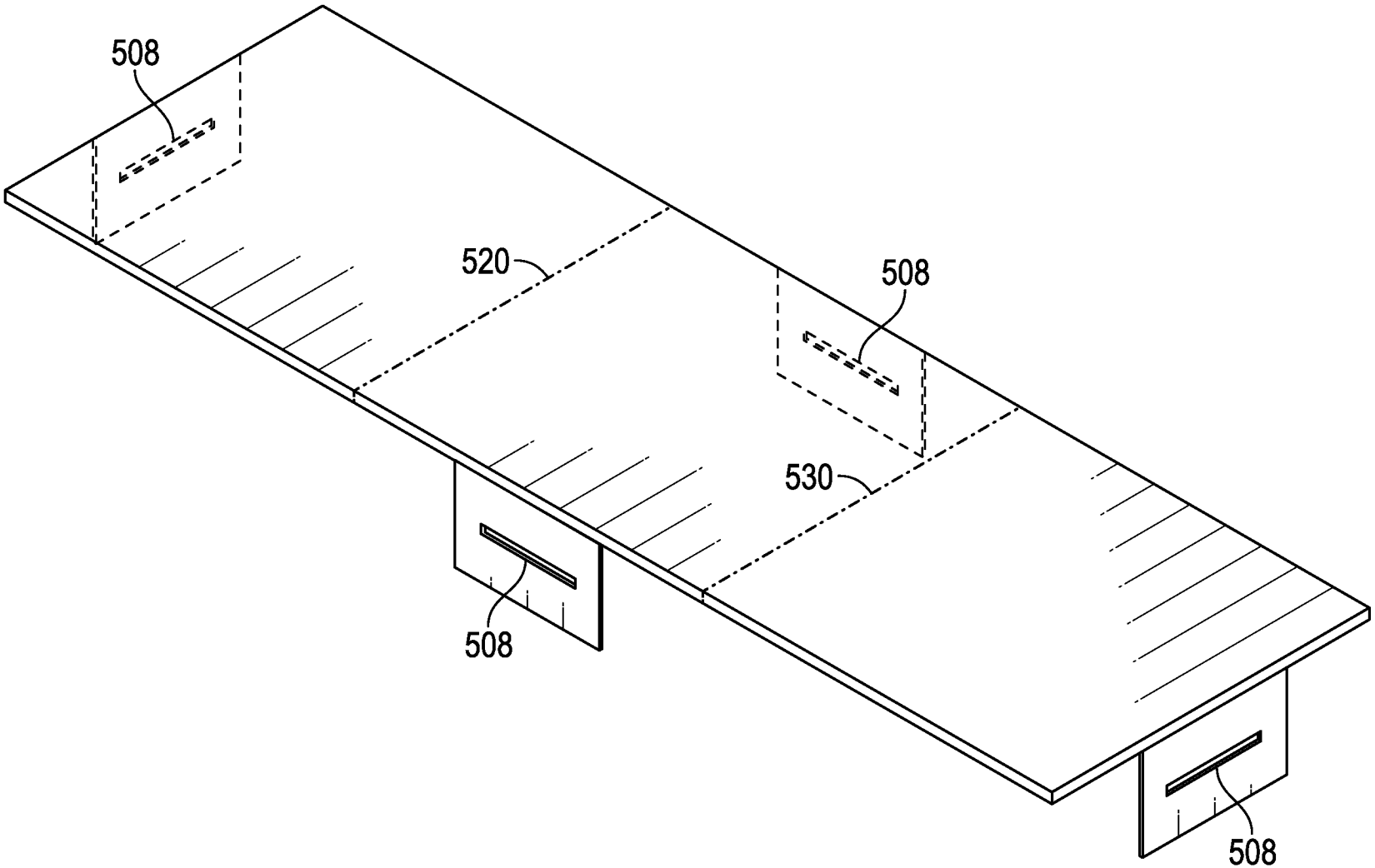
FIG. 5 shows an isometric view of a lid of the present disclosure including the clasp mechanisms.

FIG. 5 illustrates an optional foldable lid designed for use with the storage container system (100). In some aspects, the lid may be structured as a quadrilateral prism and may be divided into three sections, where the three sections correspond to one of the three foldable sections of the storage container system (100). In various aspects, this segmentation mirrors the three-fold division of the storage container system (100) itself. In some aspects, the lid may be equipped with one or more clasp mechanisms (508), strategically positioned to align with the one or more clasp catchers (108) on the storage container system (100). In addition to the one or more clasp mechanisms (508) for the distal ends, the lid may also include one or more clasp mechanisms (508) located on the lateral side walls (110) proximal to the midpoint of the storage container system (100). In some aspects, these one or more clasp mechanisms (508) may be designed to engage with the one or more clasp catchers (108) located at the distal end on the left face (104) and the right face (106) and on the lateral side walls (110) positioned proximal to the midpoint of the storage container system (100).

In various aspects, when the storage container system (100) is fully extended, the lid may be placed on top, allowing the one or more clasp mechanisms (508) of the lid to engage with the one or more clasp catchers (108) on the storage container system. When one or more foldable sections of the storage container system (100) are in a laterally condensed state, the corresponding sections of the foldable lid may be adapted to fold over the laterally condensed sections of the storage container system (100). In some aspects, engagement of the clasp mechanisms with the one or more clasp catchers (108) may provide a secure and stable closure configuration and may contain the contents of the storage container system (100) inside the storage container system (100). In certain embodiments, engagement of the clasp mechanisms with the one or more clasp catchers (108) may provide a secure and/or stable closure configuration and may ensure the contents of the storage container system (100) are protected. In various aspects, the lid design and placement of the one or more clasp mechanisms (508) may ensure the lid remains securely attached to the storage container system (100). In various aspects, the lid may be optional based on the user's purposes. In various aspects, this may add versatility to the storage container system (100).

Figure 6:
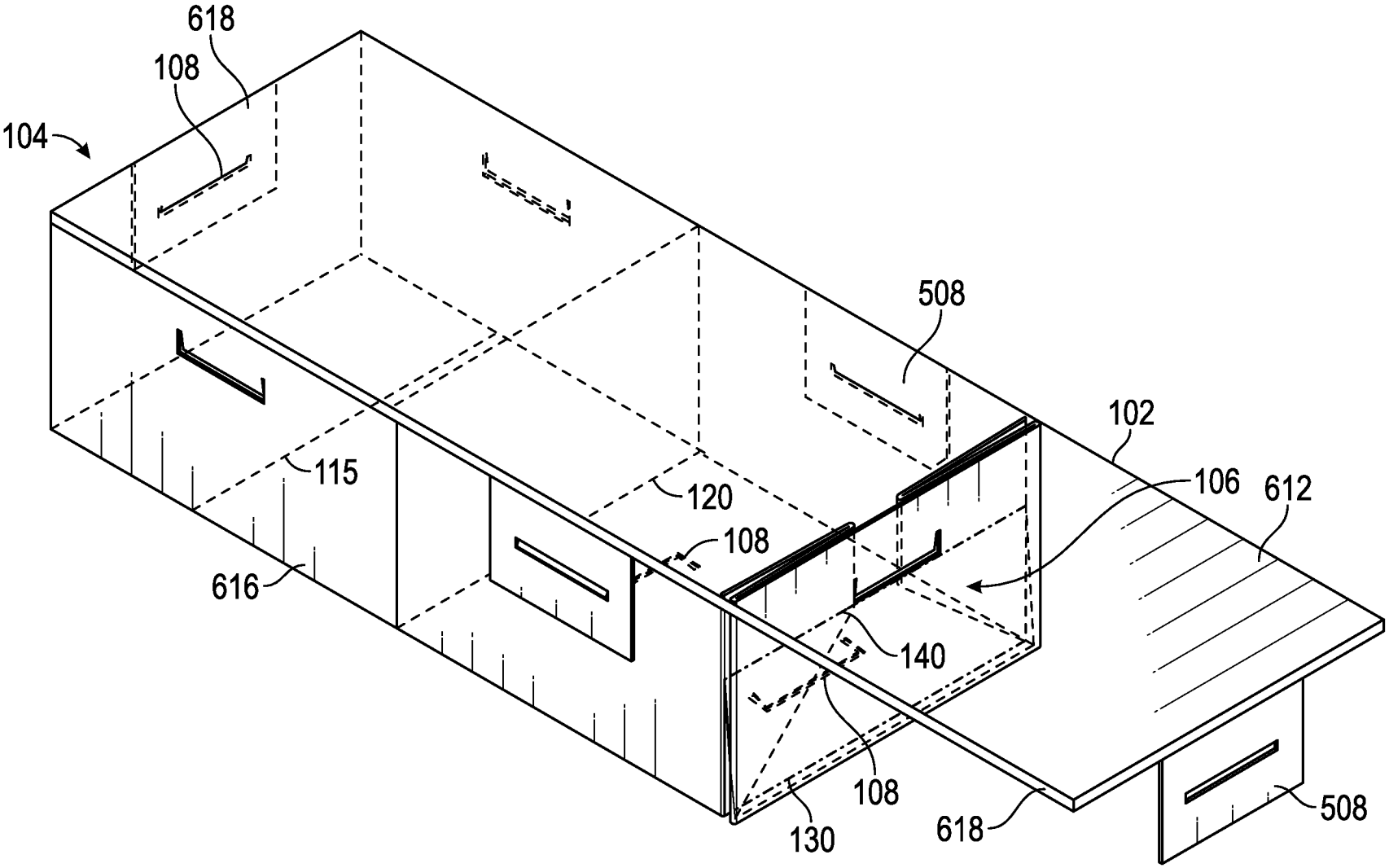
FIG. 6 shows an isometric view of the present disclosure with a foldable lid placed on the top face of the container system, where one distal end of the lid has been folded and the other distal end of the lid has not been folded.

FIG. 6 illustrates a specific configuration of the storage container system (100), where the second foldable section, including the right face (106), has transitioned from a laterally expanded state to a laterally condensed state in a similar manner to the depiction in FIG. 3. In FIG. 6, the storage container system (100) appears in a partially laterally condensed state with the lid placed on top of the remaining laterally expanded state sections including the first foldable section and the left face (104) and including the third foldable section bound by the second foldable location (120) and the third foldable location (130). In various aspects, as shown in FIG. 6, the one or more clasp mechanisms (508) of the lid may be engaged with the one or more clasp catchers (108) on the left face (104). In this particular aspect, the right side of the lid may extend beyond the laterally condensed state second foldable section including the right face (106) and may extend outward. In various aspects, the lid extending outward may fold in a downward direction toward the storage container system (100) bottom face to engage one or more clasp mechanisms (508) with one or more clasp catchers (108) located underneath the bottom face of the storage container system (100) located between the second foldable location (120) and the third foldable location (130).

In various aspects, the storage container system (100) may include plastic and/or silicone materials (618). In various aspects, these materials may offer durability, flexibility, and resistance to environmental factors. In various aspects, the use of plastic and/or silicone may contribute to the overall robustness of the system while ensuring that the foldable sections and the rigid frame maintain their structural integrity during transformation and use.

In various aspects, the storage container system (100) may be capable of adjusting its size to accommodate different storage purposes.

In some aspects, the storage container system (100) may include various volumes of various dimensions. In some aspects the storage container system (100) may transform from a fully laterally expanded configuration as a rectangular shape of approximately 30.48 cm×10.16 cm (12"×4") to a partially laterally condensed configuration of approximately 20.32 cm×10.16 cm (8"×4"), and further to fully laterally condensed state of approximately 10.16 cm×10.16 cm (4"×4"). The dimensions of the container may be customized to various sizes and various volumes, such as 22.86 cm×7.62 cm (9"×3") which may laterally condense to 15.24 cm×7.62 cm (6"×3") which may further laterally condense to 7.62 cm×7.62 cm (3"×3"). The fully laterally expanded state container may be designed with dimensions greater than or equal to 91.44 cm (36"), greater than or equal to 60.96 cm (24"), or greater than or equal to 30.48 cm (12") on one side, by dimensions greater than or equal to 30.48 cm (12"), greater than or equal to 20.32 cm (8"), or greater than or equal to 10.16 cm (4") on another side. The fully expanded container may be designed with dimensions less than or equal to 91.44 cm (36"), less than or equal to 60.96 cm (24"), or less than or equal to 30.48 cm (12") on one side, by dimensions less than or equal to 30.48 cm (12"), less than or equal to 20.32 cm (8"), or less than or equal to 10.16 cm (4") on the other side.

In certain aspects, the fully expanded storage container system may possess dimensions ranging from about 7.62 cm×about 2.54 cm (about 3"×about 1") to about 121.92 cm×about 40.64 cm (about 48"×about 16"), including but not limited to about 30.48 cm×about 10.16 cm (about 12"×about 4"), about 91.44 cm×about 30.48 cm (about 36"×about 12"), and about 60.96 cm×about 20.32 cm (about 24"×about 8"), providing a transformable ratio from about 3:1 to about 1:1, or less than about 3:1 to less than about 1:1. In certain aspects where the storage container system is partially expanded or partially collapsed, dimensions may range from less than about 15.24 cm×less than about 10.16 cm (less than about 6"×less than about 4") to more than about 50.8 cm×33.02 cm (more than about 20"×more than about 13"), with intermediate ratios that accommodate a variety of use cases and spatial requirements.

In aspects concerning the fully collapsed configuration, the storage container system may range from dimensions less than about 7.62 cm×less than about 7.62 cm (less than about 3"×less than about 3") to more than about 40.64 cm×more than about 40.64 cm (more than about 16"×more than about 16"), with a ratio that approaches 1:1, facilitating minimal spatial occupancy for ease of storage.

In certain aspects the height of the storage container system (100) may be less than or equal to about 10, about 9, about 8, about 7, about 6, about 5, about 4, about 3, about 2, about 1 cm. In certain aspects, the height of the storage container system (100) may be greater than or equal to about 10, about 12, about 14, about 16, about 18, about 20, about 22, about 24, about 26, about 28, about 30, about 32, about 36, about 38 cm. In some aspects the height of the storage container system (100) may fall in a range of about 1 to about 5 cm, about 5 cm to about 10 cm, about 10 cm to about 15 cm, about 15 cm to about 20 cm, about 20 cm to about 25 cm, about 25 cm to about 30 cm, about 30 cm to about 40 cm, or more than 40 cm tall. In certain aspects the lateral width of the storage container system (100) may be less than or equal to about 10, about 9, about 8, about 7, about 6, about 5, about 4, about 3, about 2, about 1 cm. In certain aspects, the lateral width of the storage container system (100) may be greater than or equal to about 10, about 12, about 14, about 16, about 18, about 20, about 22, about 24, about 26, about 28, about 30, about 32, about 36, about 38 cm. In some aspects the lateral width of the storage container system (100) may fall in a range of about 1 to about 5 cm, about 5 cm to about 10 cm, about 10 cm to about 15 cm, about 15 cm to about 20 cm, about 20 cm to about 25 cm, about 25 cm to about 30 cm, about 30 cm to about 40 cm, or more than 40 cm wide. In certain aspects the depth of the storage container system (100) may be less than or equal to about 10, about 9, about 8, about 7, about 6, about 5, about 4, about 3, about 2, about 1 cm. In certain aspects, the depth of the storage container system (100) may be greater than or equal to about 10, about 12, about 14, about 16, about 18, about 20, about 22, about 24, about 26, about 28, about 30, about 32, about 36, about 38 cm. In some aspects the depth of the storage container system (100) may fall in a range of about 1 to about 5 cm, about 5 cm to about 10 cm, about 10 cm to about 15 cm, about 15 cm to about 20 cm, about 20 cm to about 25 cm, about 25 cm to about 30 cm, about 30 cm to about 40 cm, or more than 40 cm deep.

Additionally, in various aspects, the storage container system (100) may be subdivided into two foldable sections. In various aspects, the storage container system (100) may be subdivided into more than three sections. In various aspects, the storage container system (100) may not be confined to linear configurations, wherein aspects may include cross-shaped or other geometric arrangements that enable multidirectional collapsibility. For example, an extended cross-shaped configuration may have arm lengths ranging from about 2.54 cm to about 76.2 cm (about 1" to about 30") on each side from the midpoint of the cross, or in certain aspects, dimensions could be less than about 2.54 cm (less than about 1") to more than about 76.2 cm (more than about 30") when measured perpendicularly from the midpoint to the end of each arm.

In various aspects, the storage container system (100) may include one or more clasp catchers (108) located on the underside of the bottom face of the third foldable section. In various aspects, the one or more clasp catchers (108) may be used to securely attach the lid and may be used to enhance the stability of the storage container system (100). In various aspects, the strategic placement of the one or more clasp catchers (108) may allow for engagement with the one or more clasp mechanisms (508) on the lid and may provide a secure and/or stable enclosure in different configurations of the storage container system (100).

In various aspects, the storage container system (100) may include three approximately square sections (612), which collectively form a rectangular shape. In various aspects, the approximately square sections (612) may house a foldable section. In various aspects, the foldable sections may allow dynamic alteration in size and shape, catering to diverse storage purposes. In various aspects, the foldable sections may enable the storage container system (100) to shift from an extended rectangular structure to a compact, square-like form and may offer a flexible and space-saving storage option.

FIG. 6 illustrates the foldable section having two parallel sides (614) relative to the two distal ends of the storage container system (100). FIG. 6 further illustrates the foldable section having two perpendicular sides (616) relative to the two distal ends of the storage container system (100).

Figure 7:
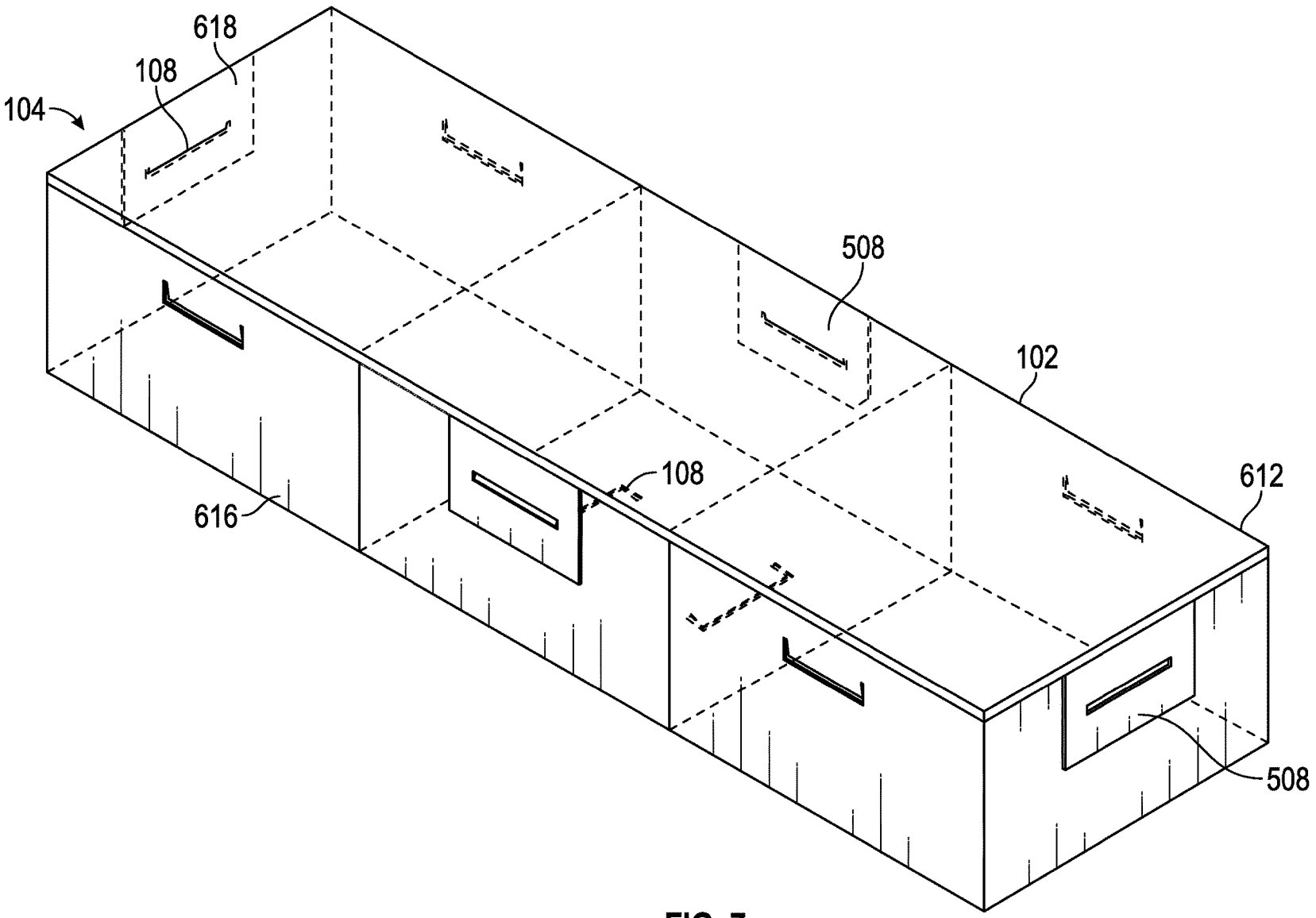
FIG. 7 shows an isometric view of the present disclosure when positioned in a laterally expanded state, with a laterally expanded lid in place and the clasp mechanisms secured.
Figure 8:
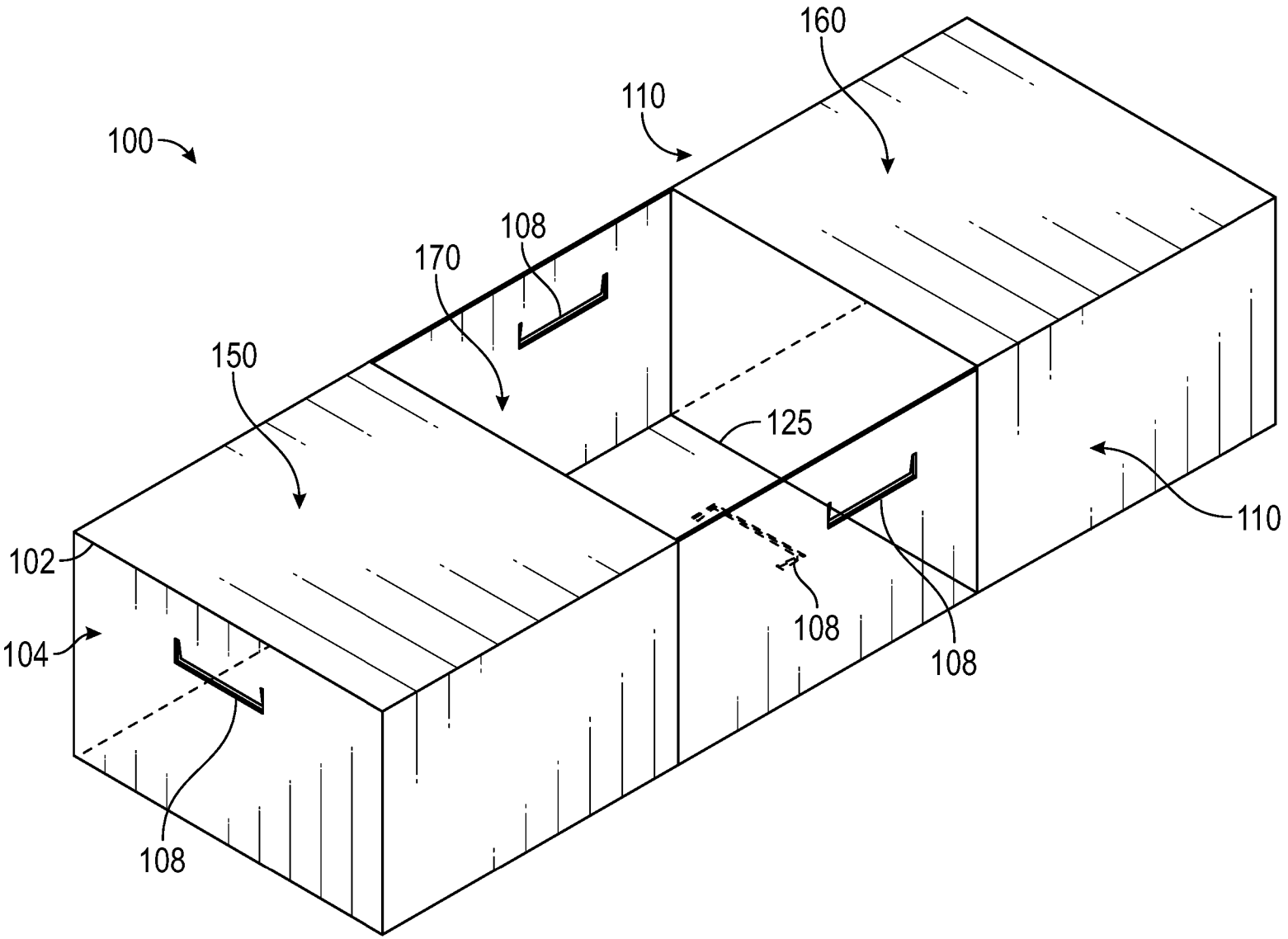
FIG. 8 shows an isometric view of the present disclosure when positioned in a laterally expanded state, with a laterally expanded lid in place and the clasp mechanisms secured and claimed.

FIG. 7 illustrates the storage container system (100) in a fully expanded state with the fully expanded lid placed on top. In various aspects of the present disclosure, the lid is shown in FIG. 7 as see-through for clarity in understanding. In certain aspects, the lid may be transparent. In other aspects the lid may be opaque. In other aspects, the lid may be translucent. In certain aspects the lid may not allow viewing the internal contents. In certain aspects the lid may contain a clasp mechanism positioned at the midpoint of each panel. In various aspects, the clasp mechanism may be engaged with one or more clasp catchers (108) to provide a secure and/or stable enclosure.

In various aspects the storage container system (100) may be deployed in various environments requiring unique storage such as in attics, including seasonal decoration storage of infrequently used items; basements, including bulk storage, utility storage; boats and marinas, including cabin storage, dock storage; children's playrooms, including toy storage, craft supplies; commercial kitchens and/or commercial refrigerators; craft rooms, including supply organization, project storage; desks, home and/or office storage spaces; home and/or office refrigerators; event venues, including decorations, tableware, chair storage; food trucks and mobile kitchens, including space-optimized storage including cooking supplies; freezers; garages, including sports equipment, automotive tools, seasonal items; gardens and sheds, including gardening tools, outdoor equipment; gyms/office lockers; home gyms, including equipment storage; hospitals and clinics, including medical supply storage, patient room storage; hotels and hospitality venues, including linen storage, guest amenities storage; industrial storage settings, warehouses, distribution centers; laboratories, including specimen storage, equipment storage; laundry rooms, including cleaning supply storage; libraries, including media and book storage, archival rooms; office spaces, including supply rooms, personal cubicles; pantries; refrigerators; retail stores, including inventory storage, display storage; RVs and campers, including space-saving storage solutions; school dormitories; sports arenas and stadiums, including equipment, merchandise storage; storage facilities, self-storage units; vehicles, including example trunks/boots, overhead compartments, under-seat storage; workshops, including tool storage, material storage; yachts and private aircraft, including luxury and specialized storage solutions and combinations thereof.

While a particular form of the invention has been illustrated and described, it will be apparent that various modifications can be made without departing from the spirit and scope of the invention. For example, each of the foldable sections and foldable locations independently may fold in the direction of another axis. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A storage container system, comprising:

a storage container configured as a first quadrilateral prism capable of transformation, the storage container comprising:

a top face and a bottom face, wherein the top face is positioned opposite from the bottom face and wherein the top face comprises a top face opening;

a left face and a right face extending between the top face and the bottom face, wherein the left face is positioned opposite from the right face;

two lateral side walls extending between the left face and the right face and oriented perpendicular thereto; wherein the top face, the bottom face, the left face, the right face, and the lateral side walls are configured as quadrilateral polygons;

a rigid frame extending to two distal ends, one located at the left face and the right face when the storage container is in a fully expanded state;

three foldable sections, wherein each occupies one-third of a storage container volume positioned at approximately equal distances from the two distal ends; and six clasp catchers, wherein one or more clasp catchers are located below each edge of the top face opening at approximately a midpoint thereof, and wherein one or more clasp catchers are positioned underneath a third foldable section on the bottom face, wherein the third foldable section is positioned central to the two distal ends.

2. The storage container system of claim 1, wherein the storage container is configured to transform between a laterally condensed state and a laterally expanded state; and wherein the rigid frame is adapted to contain various volumes of the foldable sections as part of the storage container system.

3. The storage container system of claim 1, wherein:

the rigid frame, when viewed from above the top face, comprises a series of three approximately square sections which together form a rectangular shape; and the approximately square sections house a foldable section.

4. The storage container system of claim 3, wherein:

each foldable section, when expanded and unfolded, contains a volume approximately the shape of a second quadrilateral prism;

the second quadrilateral prism having an approximately square shape when viewed from above the top face and an approximately rectangular shape when viewed from the lateral side wall, further having a top face approximately flush and collocated with one of the three approximately square sections of the rigid frame; and each foldable section having two ends parallel to the two distal ends of the storage container system and two lateral side walls perpendicular to the two distal ends of the storage container system.

5. The storage container system of claim 1, further comprising:

plastic and/or silicone materials connected to, or a part of, the rigid frame of the storage container system.

6. The storage container system of claim 1, further comprising:

a foldable lid dimensioned to cover the top face of the storage container, wherein the foldable lid is divided into three sections, the three sections corresponding to the three foldable sections of the storage container; and wherein the foldable lid includes one or more clasp mechanisms located at the two distal ends and one or more clasp mechanisms located on the lateral side walls, wherein the one or more clasp mechanisms located on the lateral side walls are positioned proximal to a midpoint of the storage container system.

7. The foldable lid of claim 6, wherein:

when one or more foldable sections of the storage container are collapsed, the corresponding one or more sections of the foldable lid are adapted to fold over one or more of the distal ends of the storage container; and wherein the clasp mechanisms of the foldable lid located at one or more of the distal ends engage with one or more clasp catchers located underneath a third foldable section on the bottom face, wherein the third foldable section is positioned central to the two distal ends; and wherein the engagement of the one or more clasp mechanisms with the one or more clasp catchers located at one or more of the two distal ends provides a secure and/or stable enclosure.

8. A storage container system, comprising:

a storage container configured as a first quadrilateral prism capable of transformation, the storage container comprising:

a top face and a bottom face, wherein the top face is positioned opposite from the bottom face and wherein the top face comprises a top face opening;

a left face and a right face extending between the top face and the bottom face, wherein the left face is positioned opposite from the right face;

two lateral side walls extending between the left face and the right face and oriented perpendicular thereto; wherein the top face, the bottom face, the left face, the right face, and the lateral side walls are configured as quadrilateral polygons;

a rigid frame extending to two distal ends, one located at the left face and the right face when the storage container is in a fully expanded state;

three foldable sections, wherein each occupies one-third of a storage container volume positioned at approximately equal distances from the two distal ends;

a foldable lid dimensioned to cover the top face of the storage container, the foldable lid being divided into three sections, the three sections corresponding to the three foldable sections of the storage container; and wherein the foldable lid includes one or more clasp mechanisms located at the two distal ends and one or more clasp mechanisms located on the lateral side walls, wherein the one or more clasp mechanisms located on the lateral side walls are positioned proximal to a midpoint of the storage container system.

9. The storage container system of claim 8, wherein the storage container is configured to transform between a laterally condensed state and a laterally expanded state; and wherein the rigid frame is adapted to contain various volumes of the foldable sections as part of the storage container system.

10. The storage container system of claim 8, wherein:

the rigid frame, when viewed from above the top face, comprises a series of three approximately square sections which together form a rectangular shape; and the approximately square sections house a foldable section.

11. The storage container system of claim 10, wherein:

each foldable section, when expanded and unfolded, contains a volume approximately the shape of a second quadrilateral prism;

the second quadrilateral prism having an approximately square shape when viewed from above the top face and an approximately rectangular shape when viewed from the lateral side wall, further having a top face approximately flush and collocated with one of the three approximately square sections of the rigid frame; and each foldable section having two ends parallel to the two distal ends of the storage container system and two lateral side walls perpendicular to the two distal ends of the storage container system.

12. The storage container system of claim 8, further comprising:

plastic and/or silicone materials connected to, or a part of, the rigid frame of the storage container system.

13. The foldable lid of claim 8, wherein:

when one or more foldable sections of the storage container are collapsed, the corresponding one or more sections of the foldable lid are adapted to fold over one or more of the distal ends of the storage container; and wherein the clasp mechanisms of the foldable lid located at one or more of the distal ends engage with one or more clasp catchers located underneath a third foldable section on the bottom face, wherein the third foldable section is positioned central to the two distal ends; and wherein the engagement of the one or more clasp mechanisms with the one or more clasp catchers located at one or more of ⁵ the two distal ends provides a secure and/or stable enclosure.

* * * * *